United States Patent [19]

Komori et al.

[11] 4,108,427

[45] Aug. 22, 1978

[54] FEEDING DEVICE

[75] Inventors: Shigehiro Komori, Yokohama; Hiroyuki Hattori, Tokyo; Tsuneki Inuzuka, Machida; Koichi Miyamoto, Tokyo, all of Japan

[73] Assignee: Canon Kabushiki Kaisha, Tokyo, Japan

[21] Appl. No.: 809,861

[22] Filed: Jun. 24, 1977

Related U.S. Application Data

[63] Continuation of Ser. No. 677,124, Apr. 15, 1976, abandoned.

[30] Foreign Application Priority Data

Apr. 18, 1975 [JP] Japan ..... 50-47250
May 6, 1975 [JP] Japan ..... 50-55076

[51] Int. Cl.[2] ..... B65H 1/28; B65H 3/44

[52] U.S. Cl. ..... 271/9; 221/34; 221/130; 271/111; 271/118; 271/162

[58] Field of Search ..... 271/9, 111, 117, 118, 271/160, 162, 170, 157, 158, 159; 355/3 R; 221/34, 130

[56] References Cited

U.S. PATENT DOCUMENTS

| | | | |
|---|---|---|---|
| 3,599,966 | 8/1971 | Del Vecchio et al. | 271/9 |
| 3,698,706 | 10/1972 | Mihojevich et al. | 271/9 |
| 3,868,044 | 2/1975 | Abe et al. | 271/9 X |
| 3,919,972 | 11/1975 | Komori et al. | 271/160 X |
| 3,936,042 | 2/1976 | Smith et al. | 271/9 |

FOREIGN PATENT DOCUMENTS

| | | | |
|---|---|---|---|
| 2,361,621 | 7/1974 | Fed. Rep. of Germany | 271/9 |

*Primary Examiner*—Bruce H. Stoner, Jr.
*Attorney, Agent, or Firm*—Fitzpatrick, Cella, Harper & Scinto

[57] ABSTRACT

A feeding device comprises a plurality of cassettes capable of supporting thereon copy mediums, a cassette cradle for holding the cassettes in an operatively associated relationship with one another, feed means for feeding the copy mediums, control means for controlling the feed means to intermittently feed the copy mediums, and means for selectively displacing the cassette cradle to at least two positions to selectively locate at least one of the cassettes at a position where it may be acted on by the feed means, whereby copy mediums may be fed from one of the cassettes.

9 Claims, 24 Drawing Figures

FEEDING DEVICE

This is a continuation of application Ser. No. 677,124 filed Apr. 15, 1976, now abandoned.

BACKGROUND OF THE INVENTION

1. Field of the Invention

This invention relates to a copy medium feeding device in a copying machine or the like which may be loaded with a plurality of types of copy mediums at a time.

2. Description of the Prior Art

Recently, in the field of copying machines or the like, there has arisen a need to enable copy mediums of different sizes, colors and qualities to be properly used to enhance the efficiency of office work. With the conventional copying machines or the like, however, it has usually been the case that a single feeding table (on which the copy mediums to be fed are placed) and the feeding device of this type has been very inefficient in that when copy mediums of different sizes, colors and qualities are used, these copy mediums on the feeding table must be newly set each time.

The cassette type feeding system has been proposed to enable quick interchange between different copy mediums. According to this system, various types of copy mediums are respectively contained in exclusive cassettes (which are box-shaped containers formed with a port for setting or feeding copy mediums therethrough) and such cassettes may be loaded on the copy medium feeding station of the copying machine or the like, as required. This system eliminates the trouble to newly set the copy mediums each time copy medium interchange is effected, but it still involves the need to remove the presently loaded cassette and replace it by another desired cassette. In addition, such system requires the space available for unused cassettes and involves the necessity of cassette loading, which in turn requires the user to be cautious in handling the cassettes. Thus, this system is still left to be improved in many points.

In an effort to eliminate these inconveniences, the double cassette system has been put into practice which always permits two cassettes to be mounted on the copying machine or the like. According to this system, two different types of copy mediums to be used are respectively contained in two cassettes in advance, and these two cassettes are loaded onto the copying machine or the like. Thus, the copy mediums may be selectively fed through a single operation such as depression of a change-over button on the operating panel of the copying machine or the like.

However, as the customer's requirement has become more and more sophisticated, there has arisen a need for copying machines or the like which will permit three or four different types of copy mediums to be selectively used, namely, which will permit the use, in combination, of not only two different sizes of copy mediums but also one or more different qualities of copy mediums (for example, tracing paper used as the stencil paper for diazo copies).

It would be possible to adapt the construction of the double cassette system for use in such a case by increasing the number of the cassettes, but this would still encounter some disadvantages in practice as will hereinafter be discussed.

Generally, the cassette type feeding device is divided into a cassette section and a feeding section, and this feeding section comprises feed means for feeding copy mediums, guide means for guiding the copy mediums to a subsequent step of process, control means for intermittently causing the feed means to act on the copy mediums, etc. Thus, the conventional double cassette system may generally be grouped into the following two types of construction.

(1) Feed Operation Selection Type

Distinct cassettes are loaded onto two independent feeding sections and the feed means may act on a selected one of the feeding sections to feed selected copy mediums from that cassette. This has widely been put into practice.

(2) Cassette Position Change-over Type

Two cassettes are disposed in a single feeding section and at the positions where the cassettes may be changed over. Each cassette may be displaced to assume the same relative position with respect to the same feed means, thereby feeding copy mediums. This has not widely been put into practice.

In the feed operation selection type which has two independent feed means provided in two steps, the change-over between the two feed means may be accomplished by electrical control and if required at all, by a very simple change-over mechanism, but this type requires a space substantially double that of a single feed means, the ratio of the distances being 2:1 as will be seen in FIG. 1 of the accompanying drawings.

Thus, provision of three or four feed means for a single machine would mean the necessity of increasing the space to three or four times and this is structurally undesirable. If unreasonable efforts were made to reduce the space by extremely reducing the number of copy mediums to be contained per cassette (usually, at least about 250 sheets is necessary), there would still remain the problem that the guide means for guiding the copy mediums to the subsequent step of process would become complicated and thus, it would almost impossible to realize a desk-top type copying machine (usually with a height of 40 cm or less).

On the other hand, the cassette position change-over type, as shown in FIG. 2 of the accompanying drawings, would be advantageous in respect of the required space inasmuch as the space would only be increased at a rate of approximately 40 to 50% of one feed means even if the number of the cassettes were increased. However, because of the need to displace the cassettes, the change-over of the cassettes would involve the necessity for a change-over mechanism in addition to the electrical control.

Therefore, displacing three or four cassettes to their respective predetermined positions and fixing them thereat would require a complicated and large-scale mechanism, which would accordingly lead to complication of the electrical control.

SUMMARY OF THE INVENTION

The present invention is directed to a feeding device which utilizes, in combination, the merits of the above-described two different types of construction with the merits and demerits thereof being fully considered.

It is therefore a first object of the present invention to provide a novel feeding device of the cassette position change-over type which is not widely known.

The fundamental concept of the present invention is disclosed in Applicant's Japanese Utility Model Application No. 120439/1969. It is a second object of the present invention to provide a feeding device in a copying machine or the like which permits three or more cassettes to be loaded onto the machine at a time.

It is a third object of the present invention to provide a feeding device which permits loading of three or more cassettes at a time and yet requires a minimum space therefor and in which change-over means is of the simplest possible construction without being one-sided to either of electrical control and mechanical change-over mechanism.

It is a fourth object of the present invention to provide a lid for cassettes which may protect copy mediums set in the cassettes against direct exposure to the atmosphere and/or outside light when the cassettes are still to be loaded onto a copying machine or the like and even when the cassettes loaded onto the machine are retracted with respect to the feeding section.

It is a fifth object of the present invention to provide a feeding device which enables two or more cassettes to be used for the same type of copy mediums.

It is a sixth object of the present invention to provide a feeding device which may feed a selected type of copy mediums by a signal from a cassette and a signal from designating means for designating the selected type of copy mediums.

It is a seventh object of the present invention to provide a feeding device in a copying machine or the like which permits loading of two or more cassettes at a time and in which one of the cassettes may comprise an auxiliary cassette for manual supply. The number of the types of copy mediums which may be loaded onto the feeding device at a time is of course the same as the number of the cassettes which can be loaded onto the copying machine or the like.

When it is desired to use a great variety of copy mediums, it is therefore desirable that those types of copy mediums having the highest frequency in use be preloaded onto the feeding device of the copying machine or the like and the other types of copy mediums be selected and loaded into cassettes each time they are used. For this purpose, a cassette for manual supply will become necessary which will readily permit a suitable quantity of copy mediums to be set therein while remaining loaded on the copying machine and without being removed therefrom each time.

Such an auxiliary cassette may often be utilized, when it is desired to copy on both sides of a copy medium, to effect copying on the other side of the copy medium already bearing a copy image on one side thereof.

It is an eighth object of the present invention to provide a novel construction for the above-described auxiliary cassette and a novel combination of such auxiliary cassette and the feeding device.

The objects and other features of the present invention will become fully apparent from the following detailed description of some embodiments taken in conjunction with the accompanying drawings.

DESCRIPTION OF THE PREFERRED EMBODIMENTS

Figure 1:
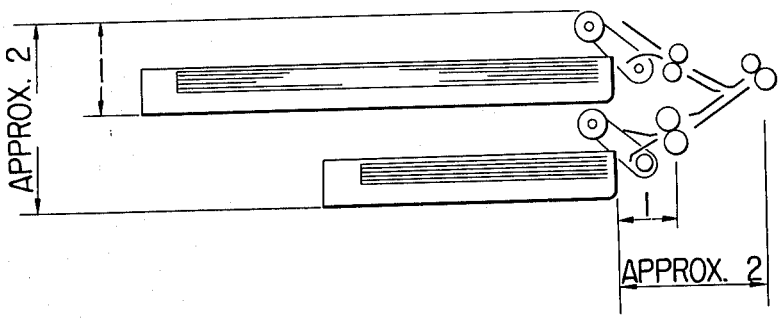
FIG. 1 PRIOR ART
FIG. 1 shows a prior art feeding device of the feed operation selection type.
Figure 2:
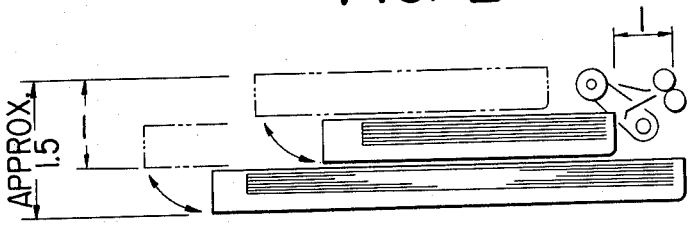
FIG. 2 PRIOR ART
FIG. 2 shows a prior art feeding device of the cassette position change-over type.
Figure 3:
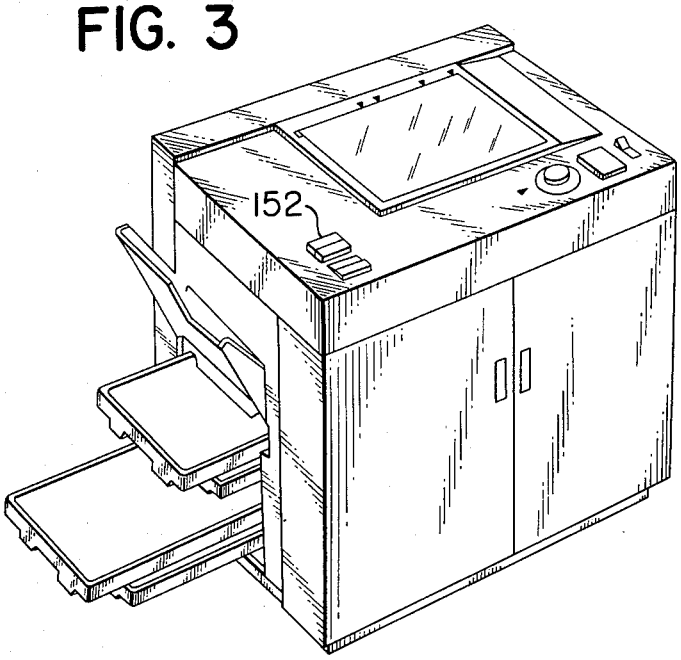
FIG. 3 is a pictorial, perspective view showing an embodiment of the present invention.
Figure 4:
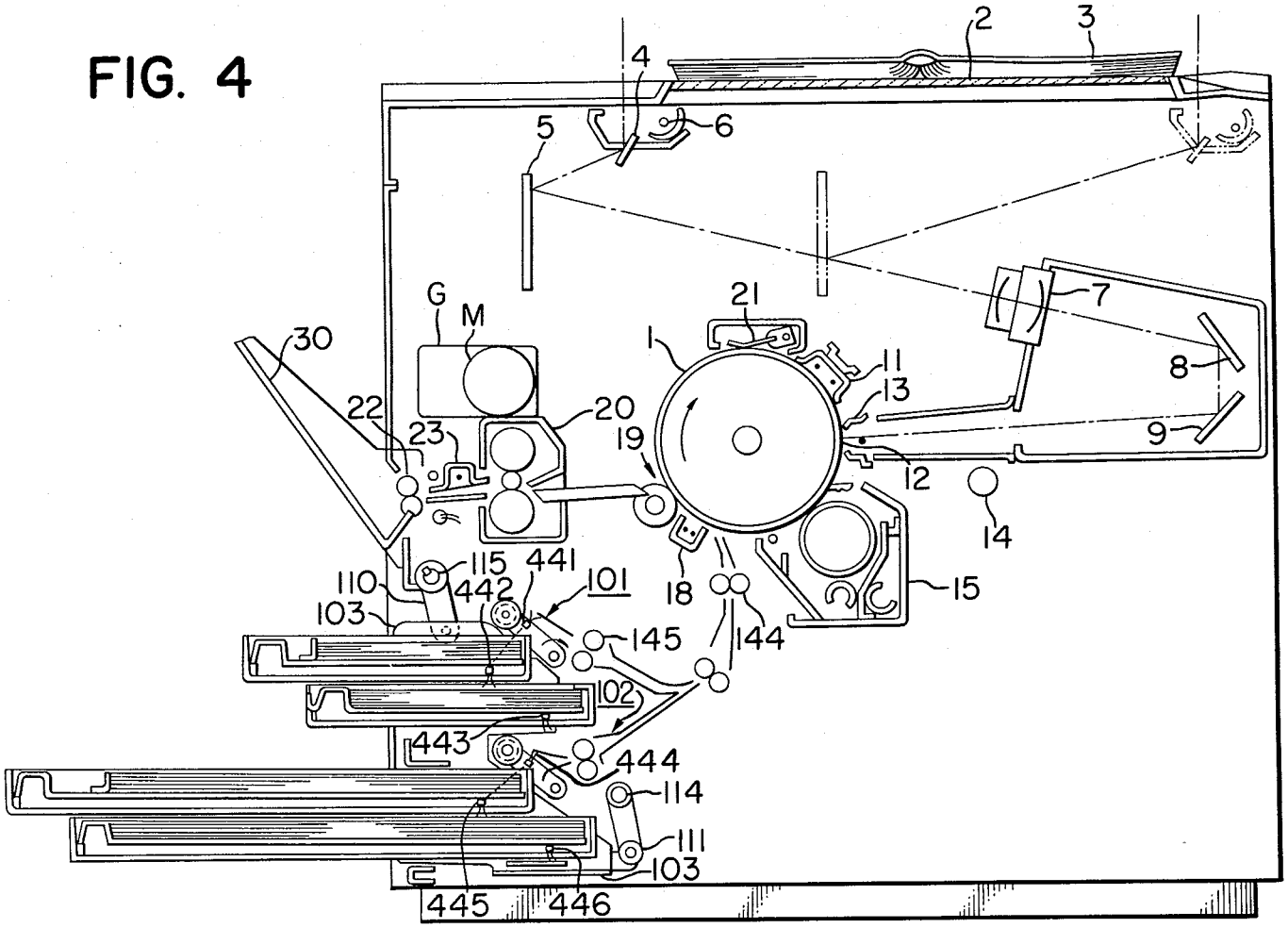
FIG. 4 is a cross-sectional view of the same embodiment.
Figure 5:
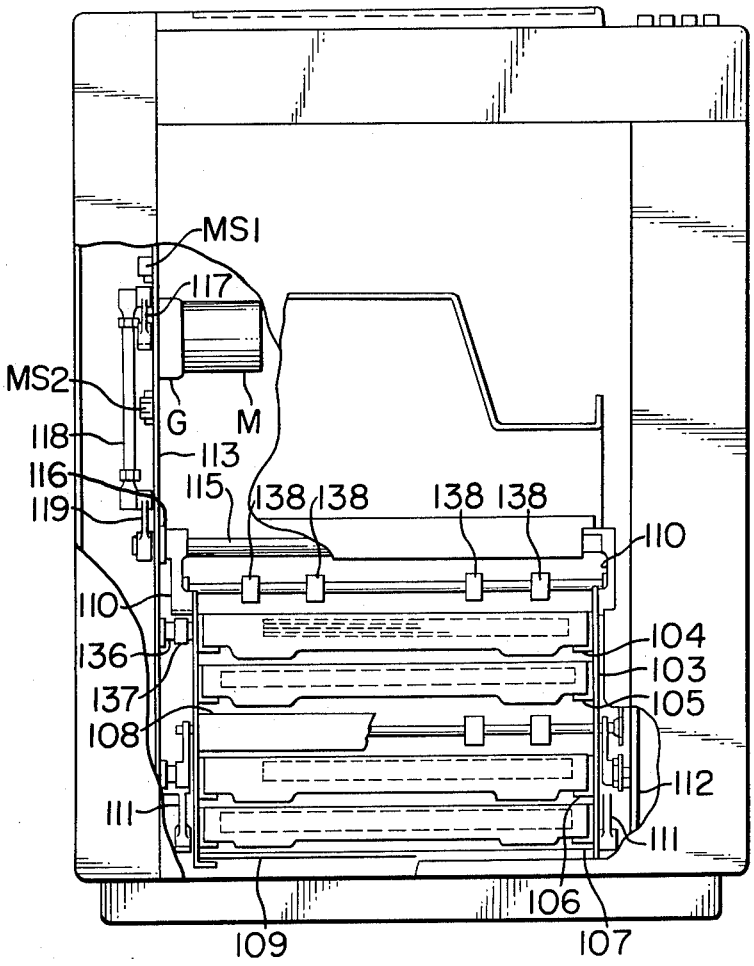
FIG. 5 is a side view of the same embodiment.

FIGS. 3 and 4 are pictorial perspective view and a cross-sectional view, respectively, of an embodiment of the present invention.

Reference will first be had to FIG. 4 to describe the operation of the copying machine shown there. An image original 3 to be copied is placed on an original carriage glass plate 2 forming the original supporting surface on top of the machine housing. The original is subjected to the slit exposure by an optical system comprising an illumination lamp 6, a movable mirror 4 movable with the lamp, a movable mirror 5 movable at half the velocity of and in the same direction as the movable mirror 4, a lens 7 and stationary mirrors 8 and 9, and the image of the original is thus formed on the surface of a drum 1. The surface of the drum 1 is a photosensitive medium formed of a photosensitive layer covered with a transparent insulating layer and electrically charged with the positive polarity by a positive charger 11 which is supplied with a positive high tension current. Subsequently, the drum 1 reaches an exposure section 12, where the photosensitive medium of the drum is exposed to the original image while, at the same time, it is subjected to AC discharge by an AC discharger 13 which is supplied with a high tension alternating current.

In subsequence, the photosensitive medium is subjected to allover exposure by an allover exposure lamp 14 to form an electrostatic latent image on the drum surface (photosensitive medium), whereafter the drum enters a developing device 15.

The electrostatic latent image is developed into a visible image by the dust development technique of the sleeve type.

Then, the image on the drum 1 is transferred by an image transfer charger 18 from the drum surface to a copy medium fed from a feeding section 101 or 102.

After the image transfer has been completed, the transfer medium is separated from the drum 1 at a separating section 19 and guided to a fixing section 20, where the image on the transfer medium is fixed, and thereafter the transfer medium has any excess charge removed therefrom by a discharger 23 and discharged onto a tray 30 by discharge rollers 22. On the other hand, the drum surface (photosensitive medium) is cleaned by a blade 21 urged thereagainst to remove any residual toner from the drum surface so that the drum may be ready for reuse in a subsequent cycle. The feeding device which forms an essential point of the present invention will now be described by reference to FIGS. 5 to 14 as well.

The copying machine, as shown in FIG. 4, includes two independent feeding sections 101 and 102 which are each loaded with two cassettes. In the figure, the upper feeding section 101 is loaded with cassettes of B5 and A4 sizes and the lower feeding section 102 is loaded with cassettes of B4 and A3 sizes. These cassettes will hereinafter be referred to as B5 cassette, A4 cassette and so on.

Figure 6:
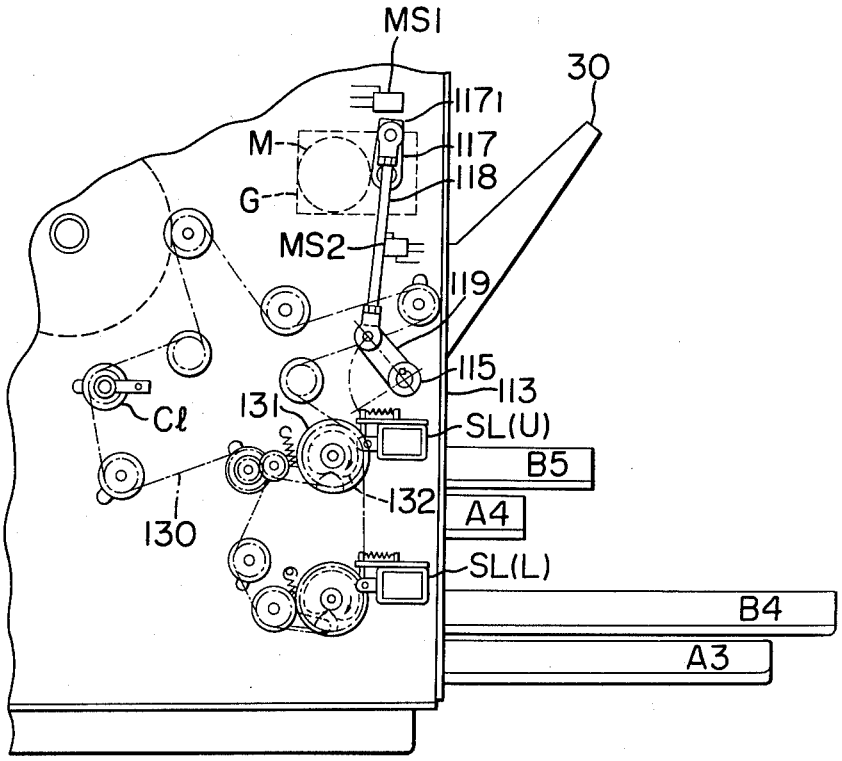
FIG. 6 is a fragmentary cross-sectional view showing the drive of the feeding device.
Figure 7:
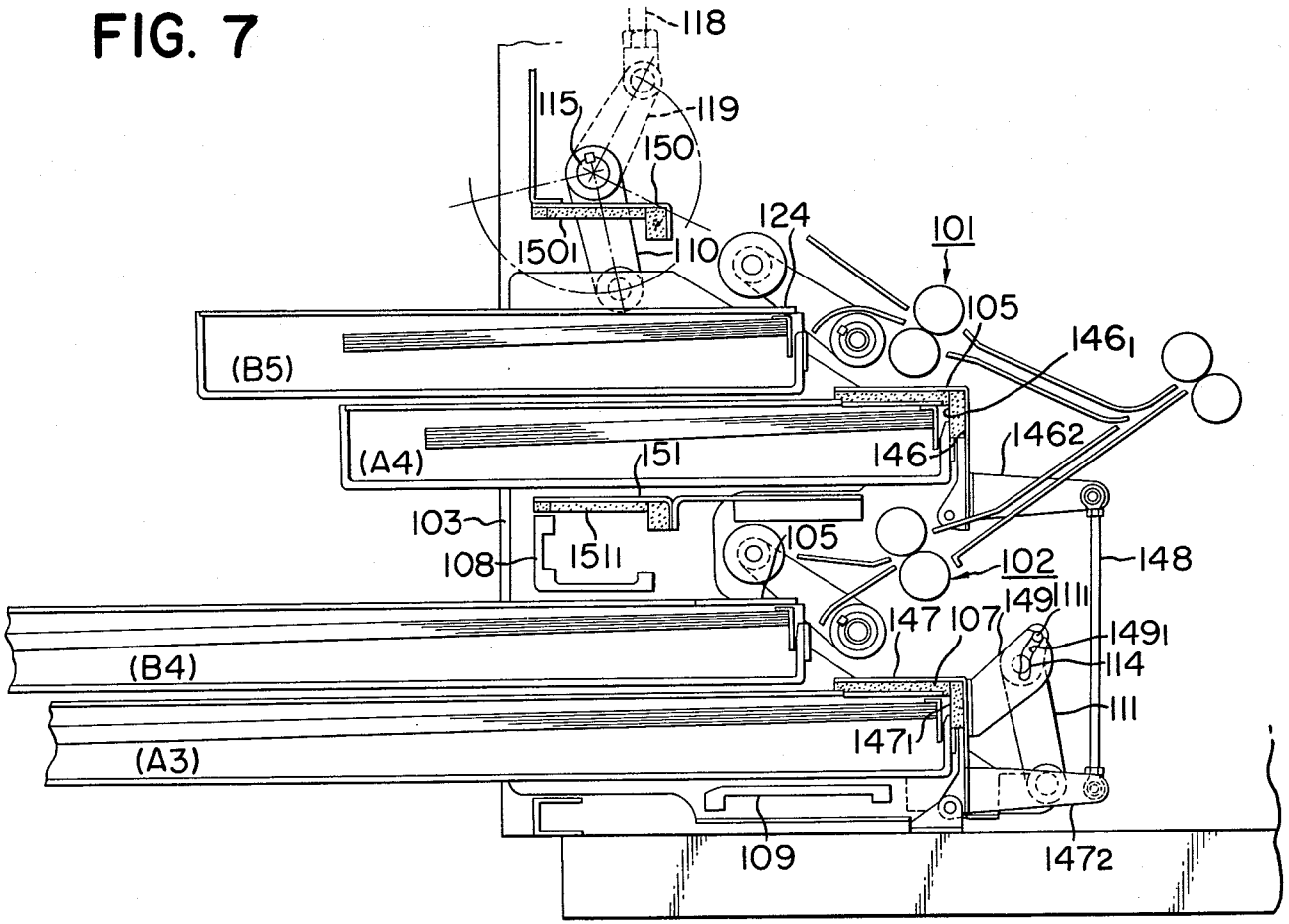
FIGS. 7 and 8 show, in cross-section, cassette change-over means.
Figure 8:
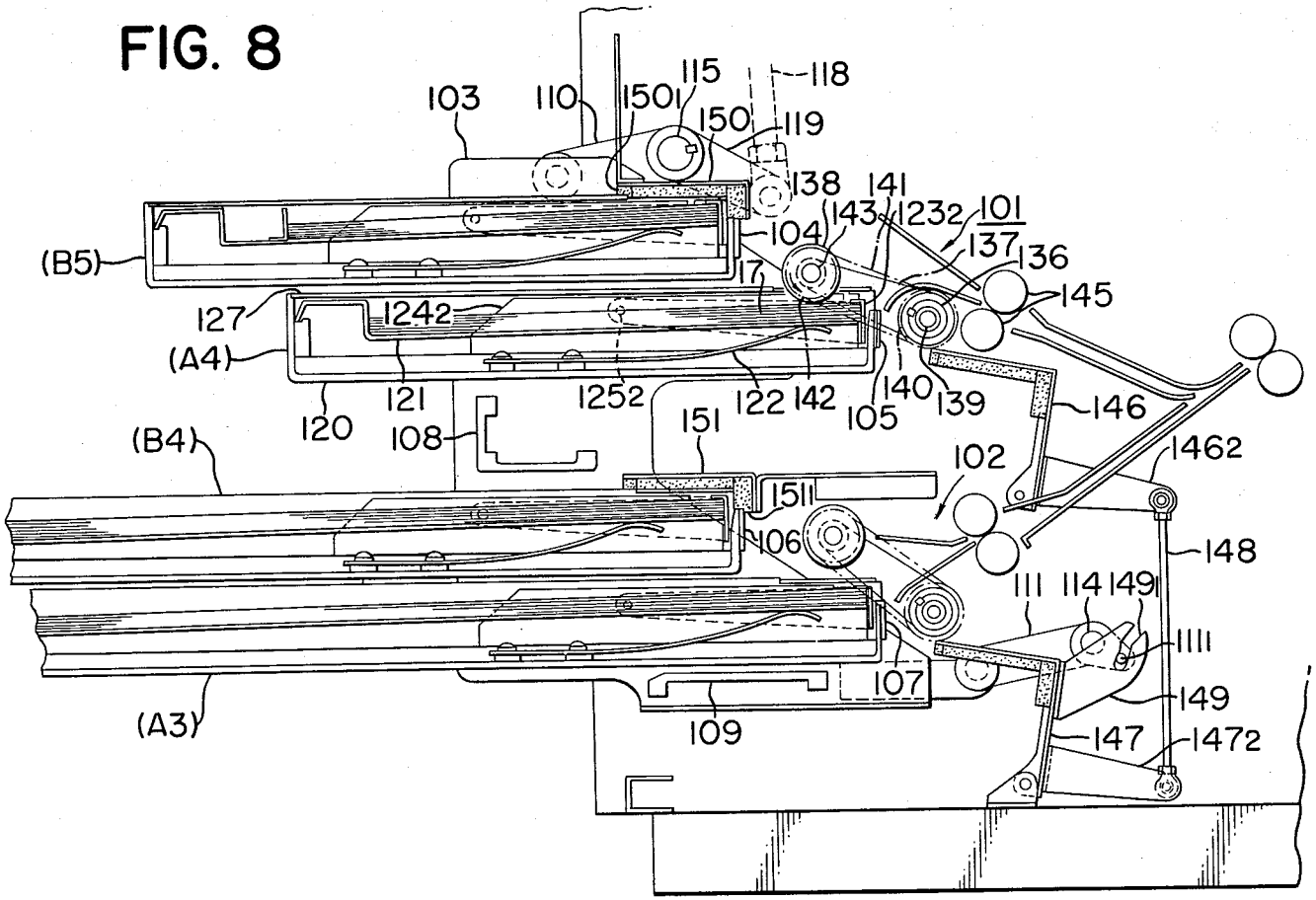

Respective ones of the cassettes are substantially horizontally disposed on cassette receivers 104, 105, 106 and 107 secured to a cassette cradle 103. The cassette cradle 103 is rigidly formed by stays 108, 109 and the like, and mounted for displacement with respect to the machine body by two pairs of pivotable links 110 and 111. The links 111 are follower links pivotable about a cantilevered shaft 114 secured to the frames 112 and 113 of the machine body. The links 110 are rigidly coupled to a displaceable shaft 115. This shaft 115 extends through the two frames and is journalled thereto by means of bearings 116. Disposed above the shaft 115 is a change-over (displacement) motor M, the movement of which is transmitted through a reduction gear G to cause rotation of a rotatable arm 117 which in turn is transmitted through a connecting link 113 to swing a swinging arm 119, thus moving the shaft 115. A cam $117_1$ is pivoted on the head of the rotatable arm 117 to actuate microswitches MS1 and MS2 which may detect and control the movement of such arm. In the position shown in FIGS. 5, 6 and 7, the rotatable arm 117 is stopped while actuating the switch MS1 and the connecting link 118 is lifted upwardly with the cassettes being in lowered position as indicated in FIG. 7. FIG. 8 shows a position in which change-over has been effected. In this position, the rotatable arm 117 has made a half rotation to actuate the switch MS2 while the connecting link 118 has been downwardly forced to thereby pivot the links 110 clockwise (FIG. 8) and the cassette cradle 103 has been lifted upwardly and leftwardly (FIG. 8) with all the cassettes supported thereon. In this manner, displacement has been effected such that, for the upper feeding section 101, the A4 cassette occupies the position which has so far been occupied by the B5 cassette and, for the lower feeding section 102, the A3 cassette occupies the position which has so far been occupied by the B4 cassette.

Figure 9:
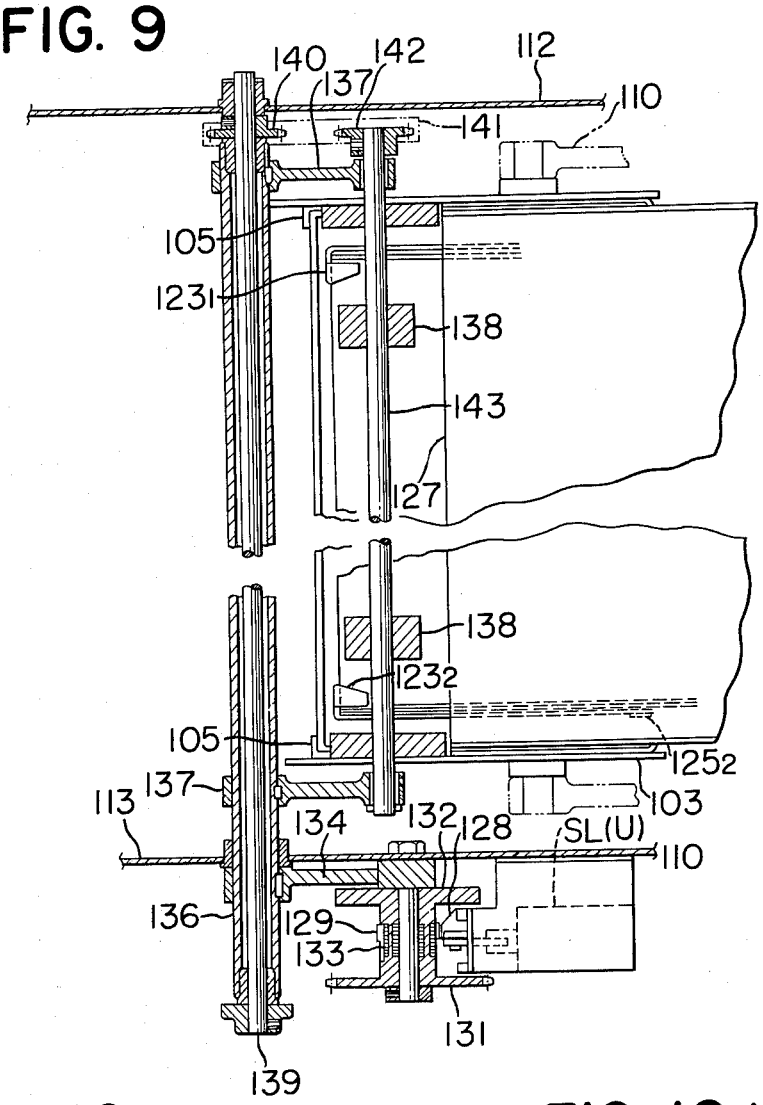
FIGS. 9, 10(*a*), 10(*b*) and 11 illustrate the feeding mechanism.

Copy medium feeding operation will now be described with respect to the A4 cassette of FIG. 8 which is in its feeding operation and by reference to FIGS. 6, 9, 10(*a*) and 10(*b*) and 12.

Disposed within a cassette housing 120 is an intermediate plate 121 serving as a support plate for copy mediums, and a leaf spring 122 is provided between the intermediate plate and the bottom of the cassette housing to bias the intermediate plate upwardly from the back side thereof. A supply stock of copy mediums 17 rests on the intermediate plate and separator pawls $123_1$ and $123_2$ are provided in the forward corners of the cassette housing corresponding to the leading end corners of the supply stock. The separator pawls $123_1$ and $123_2$ are pivotally connected to side control plates $124_1$ and $124_2$, respectively, by means of pivots $125_1$ and $125_2$ (of which the former is not shown). The pawled portions are free to move vertically but the upward movement thereof is limited by stops $126_1$ and $126_2$ provided on top of the side control plates. When no feeding operation is taking place, the force of the leaf spring 122 is limited through the intermediate plate 121, the supply stock of copy mediums 17 and separator pawls $123_1$, $123_2$ and finally by the stops $126_1$, $126_2$, whereby the level of the supply stock in this position is determined. The top of the cassette is covered with a lid 127 against exposure to the atmosphere, except for the portion thereof which is acted on by feed means (kick-out roller or the like). Upon entry of a kick-out signal into the upper feeding section, a solenoid SL(U) brings a control pawl 128 out of engagement with a fine pawl formed around a control ring 129. Hooked on the control ring 129 is one end of a clutch spring 133 which is wound over the barrel portions of both a sprocket wheel 131 and a cam 132, the sprocket wheel 131 being normally driven by a chain 130. These together constitute a spring clutch.

Upon release of the control ring 129, the spring clutch is connected to transmit the drive of the sprocket wheel 131 to the cam 132. A cam follower 134 is urged against the periphery of the cam 132 by a spring 135 and swingable with rotation of the cam 132. This swinging movement is transmitted through a pipe 136 to cause swinging movement of a kick-out arm 137, which in turn vertically moves a kick-out roller 138.

The drive to the kick-out roller is transmitted via a shaft 139 extending through the pipe 136, a sprocket wheel 140, a chain 141, a sprocket wheel 142 and a kick-out roller shaft 143 in the named order, the kick-out roller being normally in rotation.

Upon lowering of the kick-out roller 138, the copy mediums in the cassette are forced downwardly for some amount (order of 1 to 5 mm) by this roller against the force of the leaf spring 122, as shown in FIG. 8. When this occurs, the separator pawls $123_1$ and $123_2$ follow the lowering of the top surface of the copy medium supply stock from gravity, so as to hold down the leading end corners of the supply stock under a predetermined force from gravity, irrespective of the quantity of the copy mediums. The spring constant of the leaf spring 122 is determined with the thickness and weight of the copy medium supply stock being taken into account, and is designed such that the contact pressure between the kick-out roller 138 and the copy mediums 17 is hardly variable irrespective of the quantity of the copy mediums.

By these, it is ensured that copy mediums be separated and fed one by one.

Figure 10A:
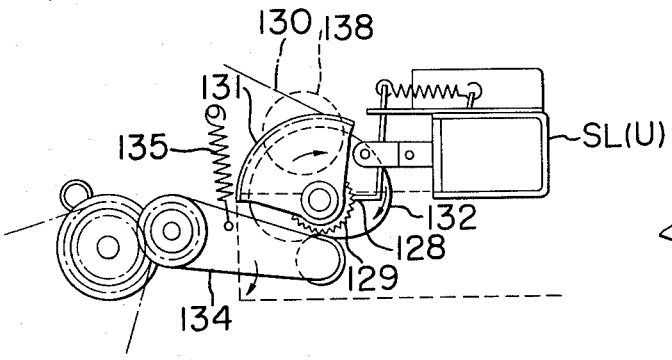
Figure 10B:
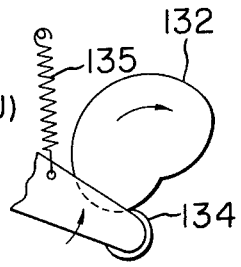
Figure 11:
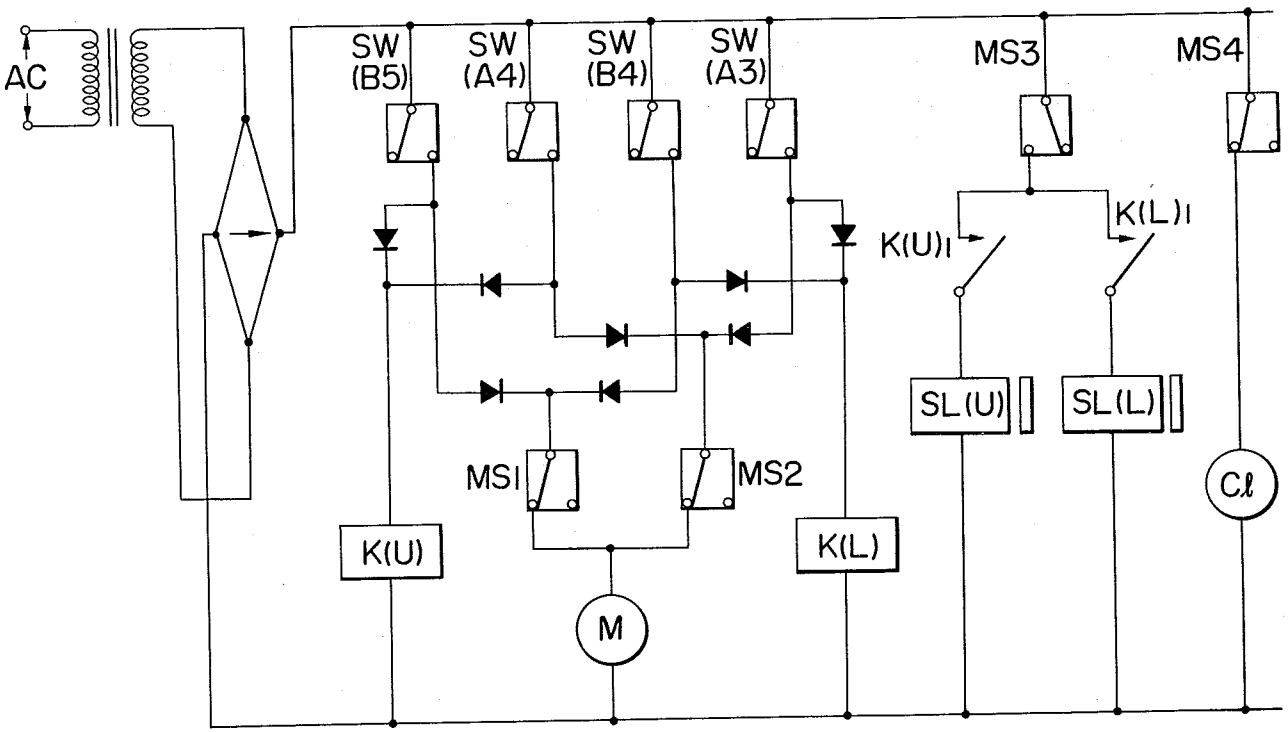

A sheet of copy medium fed from the cassette is nipped between subsequent transport rollers 145 and the cam makes substantially a complete rotation as shown in FIG. 10(*b*), whereupon the signal to the solenoid SL(U) is cut off to permit the control panel 128 to again restrain the control ring, thus disconnecting the clutch. At this point, however, the cam follower 134 is about to descend from the higher portion of the cam toward the valley portion as shown in FIG. 11, so that the cam 132 is rotated by the force of the spring 135 to come to a halt at the most stable position as shown in FIG. 10(*a*), thus permitting a similar cycle to take place for a subsequent feed signal. The copy medium so fed is further transported through a guide and transport rollers, and then transported keeping accurate timing with the image on the drum with the aid of a timing roller 144 (FIG. 4). A clutch CL (FIG. 6) is provided on the timing roller concentrically therewith. The present invention further provides a sealing device for isolating the unused copy mediums in the cassette from the atmosphere as far as possible. Such sealing device is shown in FIGS. 7 and 8.

Figure 12:
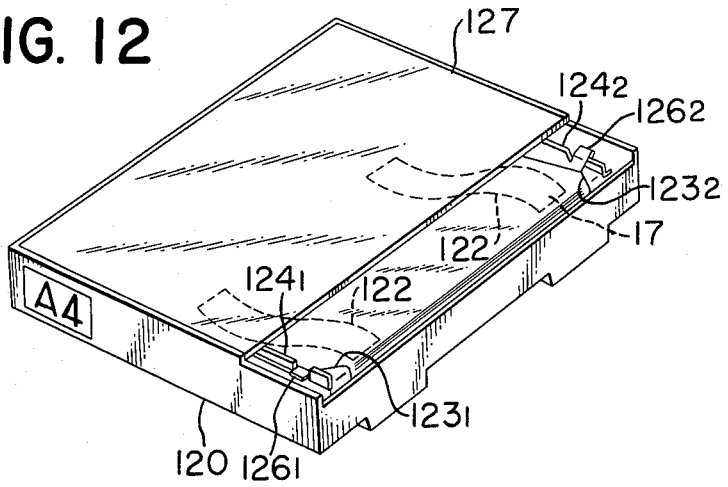
FIG. 12 is a pictorial, perspective view of a cassette.

In FIG. 7, the B5 and B4 cassettes are in their feeding positions and their forward ends are open to permit the kick-out roller to act thereon as already described (in FIG. 12, etc.) The A4 and A3 cassettes are retraced from their feeding positions. As shown, sealing lids 146 and 147 for sealing the open ends of the A4 and A3 cassettes are provided at the forward ends of these two cassettes. Sealing members $146_1$ and $147_1$ formed of flexible material such as urethane foam or the like are adhesively secured to the portions of the sealing lids which bear against the cassette openings, thus completing the sealing. The sealing lids 146 and 147 are pivotally mounted at their lower ends on the machine body and operatively connected to respective arms $146_2$ and $147_2$ by a connecting bar 148. A cam plate 149 is attached to the sealing lid 147 of the lower feeding section 102, and a pin $111_1$ secured to the follower link 111 is received in the camming groove $149_1$ of the cam to orient the sealing lid in the position as shown, thus accomplishing the sealing of the cassette.

In FIG. 8, the A4 and A3 cassettes are in their feeding positions and the B5 and B4 cassettes are in their retracted positions. As the A4 and A3 cassettes are displaced to their feeding positions, the follower link 111 is rotated to thereby cause the pin $111_1$ secured thereto to be revolved about the pivot 114 and slide in the camming groove $149_1$ to actuate the cam plate and accordingly actuate the sealing lid 147 and its associated sealing lid 146, whereby these sealing lids are opened so as not to interfere with the displacement of the A3 and A4 cassettes, as shown. In the retracted positions of the B5 and B4 cassettes, the sealing lids 150 and 151 secured to the machine body are waiting and when these cassettes are oriented in their retracted positions, the sealing lids 150 and 151 may accomplish sealing by slightly compressing the sealing members $150_1$ and $151_1$ adhesively secured thereto.

Reference will now be had to FIG. 11 to describe the feed control circuit. A group of cassette selector switches are present on the operating panel forming the top of the machine body (FIG. 3). For example, if the A4 cassette is selected, a switch SW(A4) is closed to energize a relay K(U) and at the same time, the change-over motor M is energized through the contact of the switch MS2 to cause the cam $117_1$ at the end of the rotatable arm 117 to actuate the switch MS2 to open the contact thereof, thus deenergizing the motor. By this, the connecting link 118 is forced downwardly to displace the group of cassettes to the position shown in FIG. 8. A feed signal is produced from a switch MS3 to energize the solenoid SL(U) through the closed contact K(U)1 of the relay K(U), so that the kick-out roller 138 is lowered to effect the feeding, as already described. A switch MS4 produces a timing signal which controls the timing clutch CL. The operation when other cassette is selected may readily be seen from FIGS. 11 and so on.

Figure 13:
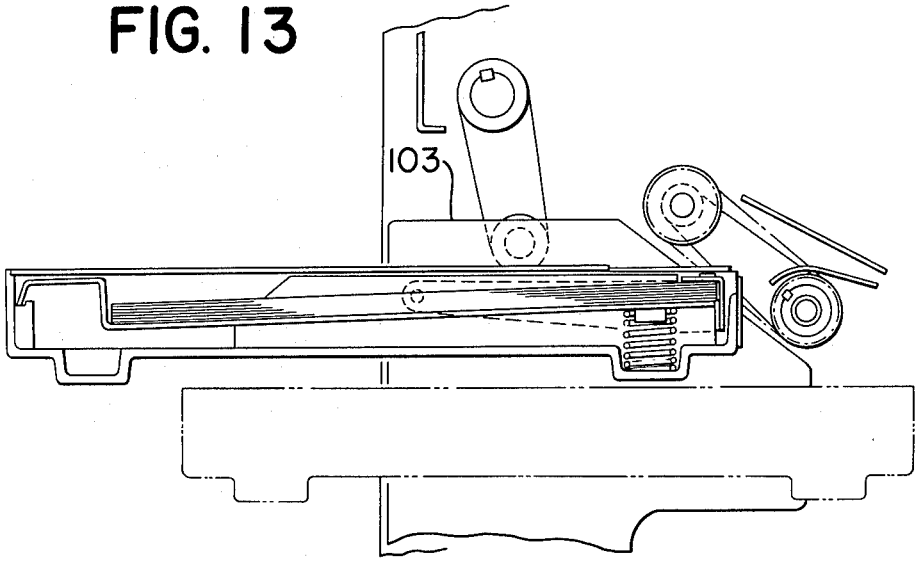
FIGS. 13 and 14 are cross-sectional views showing another embodiment of the cassette.
Figure 14:
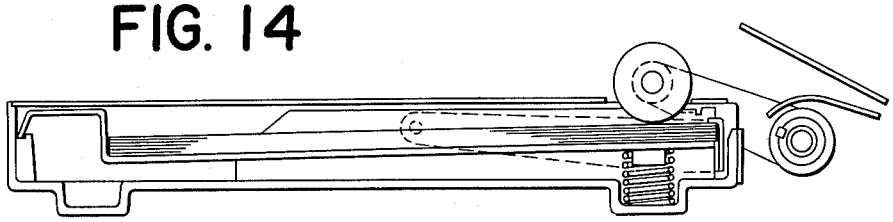

FIGS. 13 and 14 show another embodiment of the cassette. In this embodiment, a coil spring instead of a leaf spring is disposed between the intermediate plate and the cassette housing. This shows that just the same effect as described above may be obtained even if the leaf spring as shown in FIG. 8 is not employed.

According to the present invention, as has hitherto been described, two cassettes are provided for the same feed means and each of these cassettes is displaceable to assume the same relative position. Thus, the space occupied by the two cassettes in the machine body is slightly greater than the space occupied by a single cassette disposed, and this leads to an extremely compact construction.

Also, the present invention employs the cassette position change-over system in combination with the conventional feed operation selection system and thus enables four different cassettes to be selected in spite of the fact that there are only two prescribed positions available for the cassettes (the lifted and the lowered position). In addition, this fact that only two prescribed positions are available for the cassettes leads to the possibility that the change-over mechanism therefor may be simply formed by only two pairs of links and a motor or the like for moving them, which in turn leads to high reliability and low manufacturing cost of such mechanism.

It will further be possible to load two or more cassettes with copy mediums of the same size so that, after one of the cassettes has been used up, feeding may be automatically effected from another cassette.

Furthermore, according to the present invention, any of the cassettes when retracted from the feeding position may be automatically covered with a lid against exposure to the atmosphere, thus minimizing the instability of feeding and the unreliability of image transfer which is attributable to the moisture absorption of copy mediums as is often the case with the cassette type copying machine.

The invention has been described with respect to an embodiment which employs, in combination, the feed operation selection system and the cassette position change-over system to enable one of four different cassettes to be selected, whereas the invention is not restricted thereto. For example, the present invention also covers an arrangement in which two cassettes are provided for a single feed, guide and control means (the double cassette system of the cassette position change-over type). It will also be apparent that the invention covers an arrangement in which two cassettes are provided for only one of two feed, guide and control means and these two cassettes are of the cassette position change-over type so that selection may be done from among three cassettes in all.

Further, the present embodiment has been shown as being applied to an image transfer type copying machine, whereas the invention is not restricted thereto but equally applicable to the direct electrophotographic copying machines and other various types of copying machines and printing machines. In this context, these are herein referred to as "copying machines or the like".

Also, the term "copy mediums" appearing herein refers to members for bearing copy images thereon, including various types of copy paper such as blank photosensitive paper for image transfer and insulative paper, transparent paper, transparent film, etc.

The term "cassettes" used herein is not restricted to the detachable box-shaped ones but includes those which are constructed in the form of drawers for containing copy mediums therein.

Further, the cassettes used are not restricted to the shown B5, A4, B4 and A3 cassettes but it will be apparent that cassettes containing therein copy mediums of the same size but of different qualities or copy mediums of different colors may be used in combination.

Figure 15:
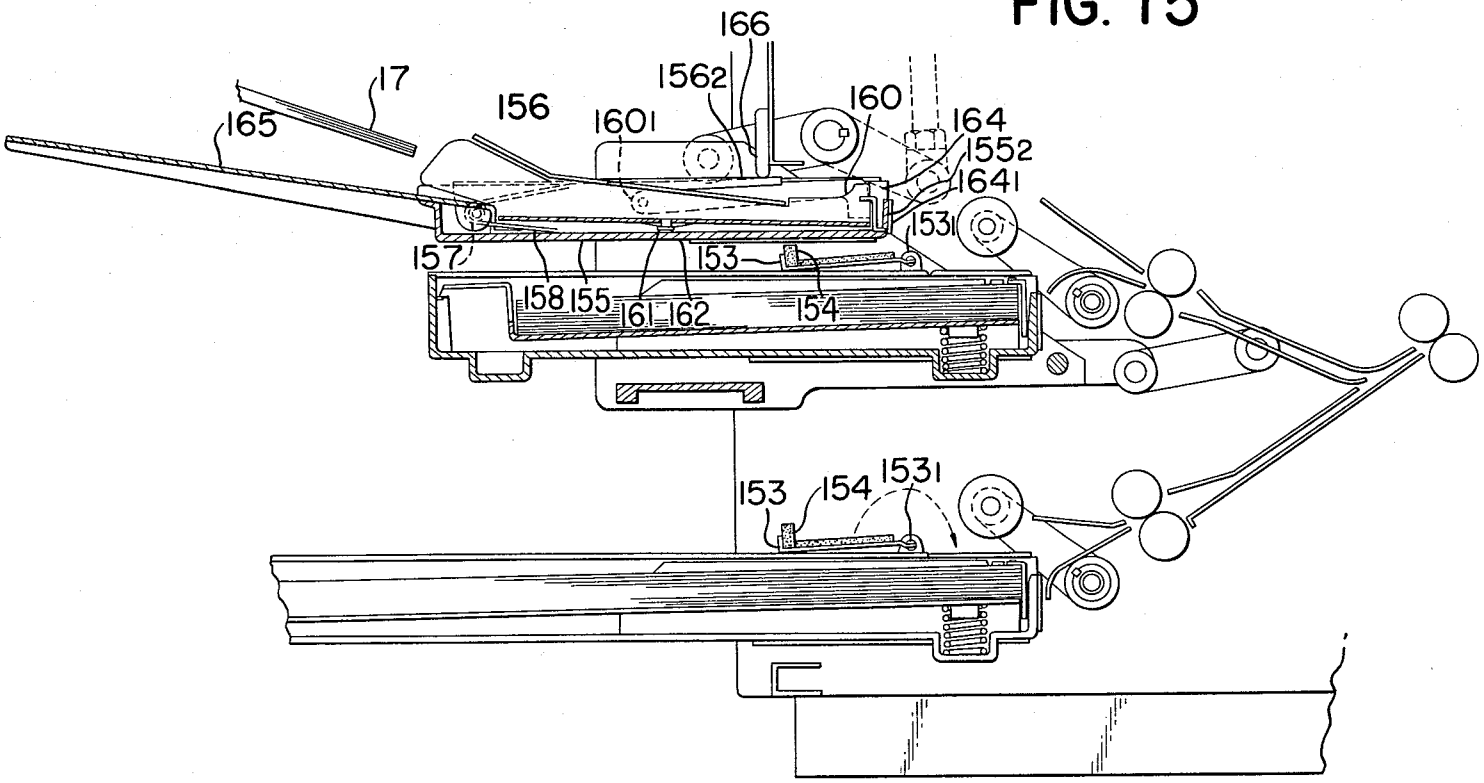
FIGS. 15 and 16 are cross-sectional views of the feeding device loaded with an auxiliary cassette.
Figure 16:
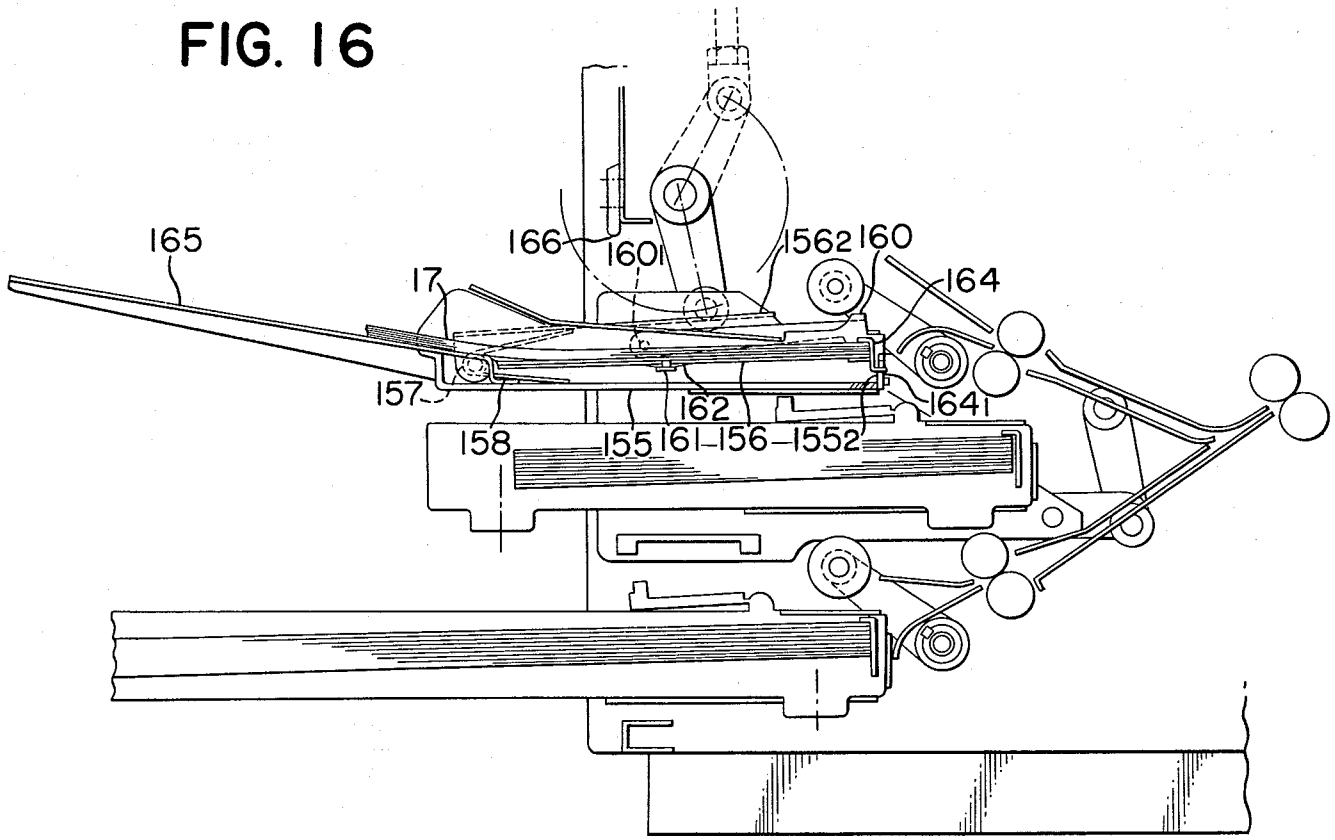
Figure 17:
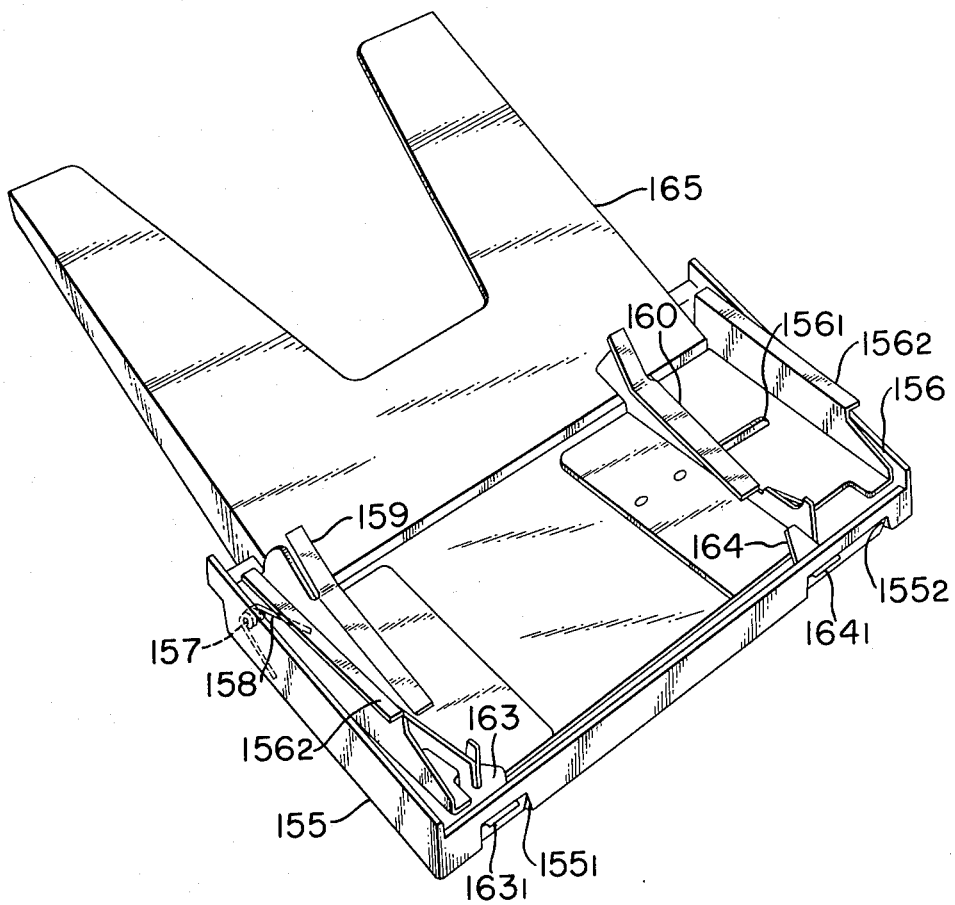
FIG. 17 is a perspective view of the auxiliary cassette.

FIGS. 15 to 17 show a further embodiment of the present invention. The lower feeding section has a single cassette secured thereto and the upper feeding section is designed to permit change-over of the cassette position. In this embodiment, the two upper and lower cassettes are the main cassettes and an auxiliary cassette is additionally provided on the upper feeding section.

The auxiliary cassette will only be described because the cassette position change-over operation is the same as that described in connection with the previous embodiment (although, in this embodiment, each of the main cassettes is in itself equipped with a sealing lid 153 provided with a sealing member 154 and the sealing lid is pivotable about the hinge portion $153_1$ thereof so as to seal the cassette against exposure to the atmosphere when the cassette is removed from the machine body). With the cassette housing 155, an intermediate plate 156 serving as a copy medium supporting plate is pivotally supported by a pivot 157 and biased upwardly (counterclockwisely in FIGS. 15 and 16) by a torsion spring 158. Side control plates 159 and 160 for copy mediums are attached to the intermediate plate. One of the side control plates, 159, is secured to the intermediate plate 156, while the other side control plate 160 is guided by an underlying guide dowel 161 and a guide slot $156_1$ in the intermediate plate and given a moderate degree of friction by a leaf spring 162 so that it is adjustable in accordance with the width of the copy medium. Separator pawls 163 and 164 are pivotally mounted on the side control plates 159 and 160 by means of pivots $160_1$ secured to the side control plates. These separator pawls have bent portions $163_1$ and $164_1$ at the lower ends thereof which are adapted to fit in holes $155_1$ and $155_2$ in the cassette housing to thereby limit the vertical movement of the separator pawls. Provided on the rear end of the cassette housing is an insertion table 165 which assists in insertion of copy mediums and also provides a table for supporting the rear half of copy medium if it is of a large size. In FIG. 15, the auxiliary cassette is shown in its retracted position. In such position, the intermediate plate has its upper edge $156_2$ relatively forced down by a hold-down member 166 secured to the machine body. Separator pawls 163 and 164 are lowered from gravity to such an extent that the lower ends thereof contact the lower edges of holes $155_1$ and $155_2$ of the cassette, but as shown in FIG. 15, the movement of the separator pawls are so much limited that a sufficient spacing is provided between the separator pawls and the intermediate plate to permit insertion of copy medium 17 therethrough. In FIG. 16, the auxiliary cassette is shown in its feeding position. The upward movement of the intermediate plate imparted by the spring 158 is stopped by the lower ends $163_1$ and $164_1$ of the separator pawls striking against the upper edges of the cassette holes $155_1$ and $155_2$ with the supply stock of copy mediums 17 and the separator pawls 163, 164 being interposed therebetween, whereby the upper edge of the copy medium supply stock is oriented in position. The feed operation of the present cassette is the same as that described with respect to the A4 cassette of FIG. 8 and need not be described. This auxiliary cassette may conveniently be used when copying is to be effected on copy mediums of special qualities, sizes or colors or when it is desired to effect copying on the other side of copy medium already bearing a copy image on one side thereof. Also, a special copy button for effecting copying only on the copy mediums in the auxiliary cassette may be provided on the operating panel so that, after the auxiliary cassette is loaded with copy mediums, this button may be depressed to automatically displace the auxiliary cassette to its feeding position to thereby effect feeding of copy mediums. When the stock of copy mediums is exhausted in the auxiliary cassette, the copying operation of the machine will be stopped and the auxiliary cassette will restore its retracted position. Such control may be provided by the special copy button. This will be useful in further enhancing the feature of the present auxiliary cassette.

In the embodiment now under discussion, the auxiliary cassette is normally empty and may particularly effectively function when copy mediums are manually supplied thereto. Also, it is of course possible to provide such a control that the auxiliary cassette is normally loaded with copy mediums of the type which is rarely used.

Figure 18:
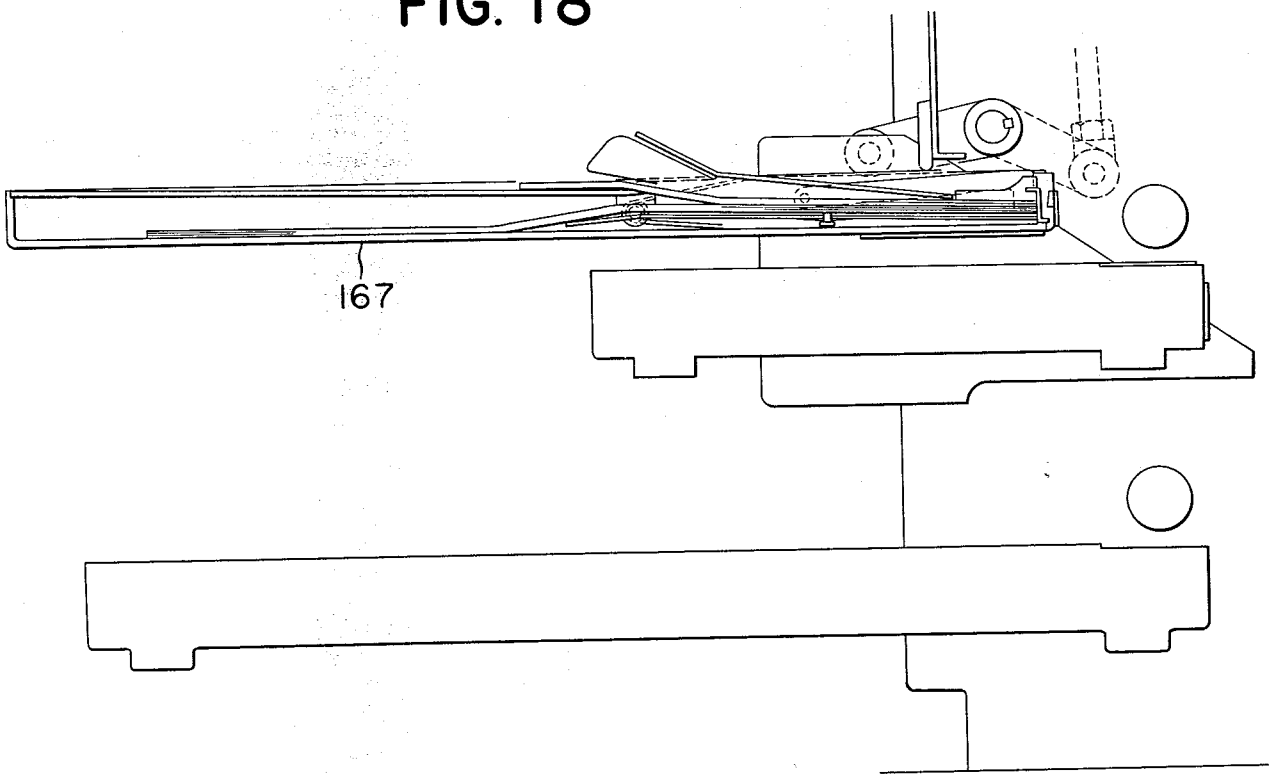
FIGS. 18, 19, 20 and 21 are cross-sectional views showing various forms of the auxiliary cassette.
Figure 19:
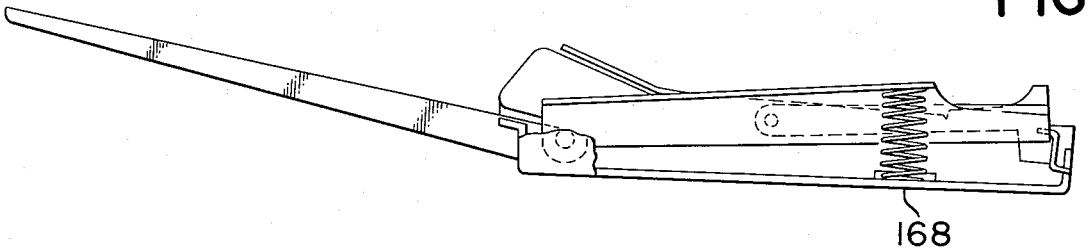
Figure 20:
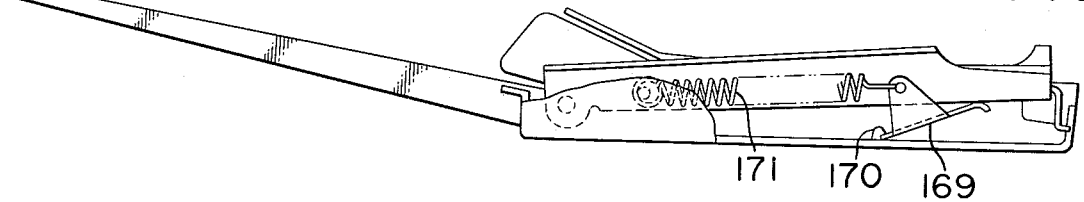
Figure 21:
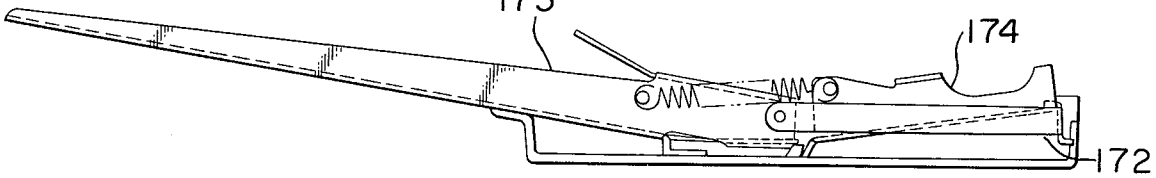

FIG. 18 shows an example of the auxiliary cassette which may normally be loaded with copy mediums of the rarely usable type and which permits manual replenishment. This auxiliary cassette is similar in construction and operation to that shown in FIG. 15, with the exception that copy mediums may be contained in the cassette housing 167 and may also manually supplied by inserting a hand therein through the top surface thereof. This embodiment will permit such a mode of utilization that copy mediums of the types having the highest frequency in use are contained in the main cassettes and copy mediums of the type which is occasionally used are contained in the auxiliary cassette but copy mediums of the other special types are manually supplied. This will further enhance the effectiveness of the auxiliary cassette. Moreover, such embodiment requires a smaller space and simpler contruction than the first embodiment. Usually, in common offices, there are two types of copy mediums having the highest frequency in use and a type of copy medium which is only occasionally used, while there are considerably many types of copy mediums which are rarely used. In view of such situations, it may be said that the present embodiment is greater in the effect/cost ratio than the first embodiment. The auxiliary cassette should desirably be constructed in a compact and thin form as much as possible, when viewed from its role as auxiliary. Therefore, in the embodiment shown in FIGS. 15–17 and FIG. 18, the spring for upwardly biasing the intermediate plate is disposed on the pivot of the intermediate plate. Different spring arrangements are shown in FIGS. 19 to 21. The arrangement of FIG. 19 has a spring 168 disposed below the bent portion of the intermediate plate. In the arrangement of FIG. 20, an upwardly forcing member 169 is disposed below the intermediate plate and one end of such member is hooked on a projection 170 formed on the bottom wall of the cassette housing while the other end of the member is bent in an ear shape on which a spring 171 is hooked. This arrangement permits the free length of the spring to be increased and thus, permits the coil diameter of the spring to be reduced, so that the arrangement is suitable for accommodating the spring in an elongated space as shown. In FIG. 21, part of the intermediate plate is constructed in the same form as the upwardly forcing member 169 of FIG. 20. In this arrangement, the intermediate plate to be upwardly raised may be small and accordingly, only a small portion of copy mediums will have to be upwardly raised, so that the spring may be smaller in size than that shown in FIG. 20. In the arrangement of FIG. 21, separator pawls are shown to be attached to an insertion table 173, whereas it may also be attached to the movable intermediate plate 174 as in the previous arrangements. These spring arrangements are of course applicable to the auxiliary cassette shown in FIG. 18, as well as to the main cassettes.

Figure 22:
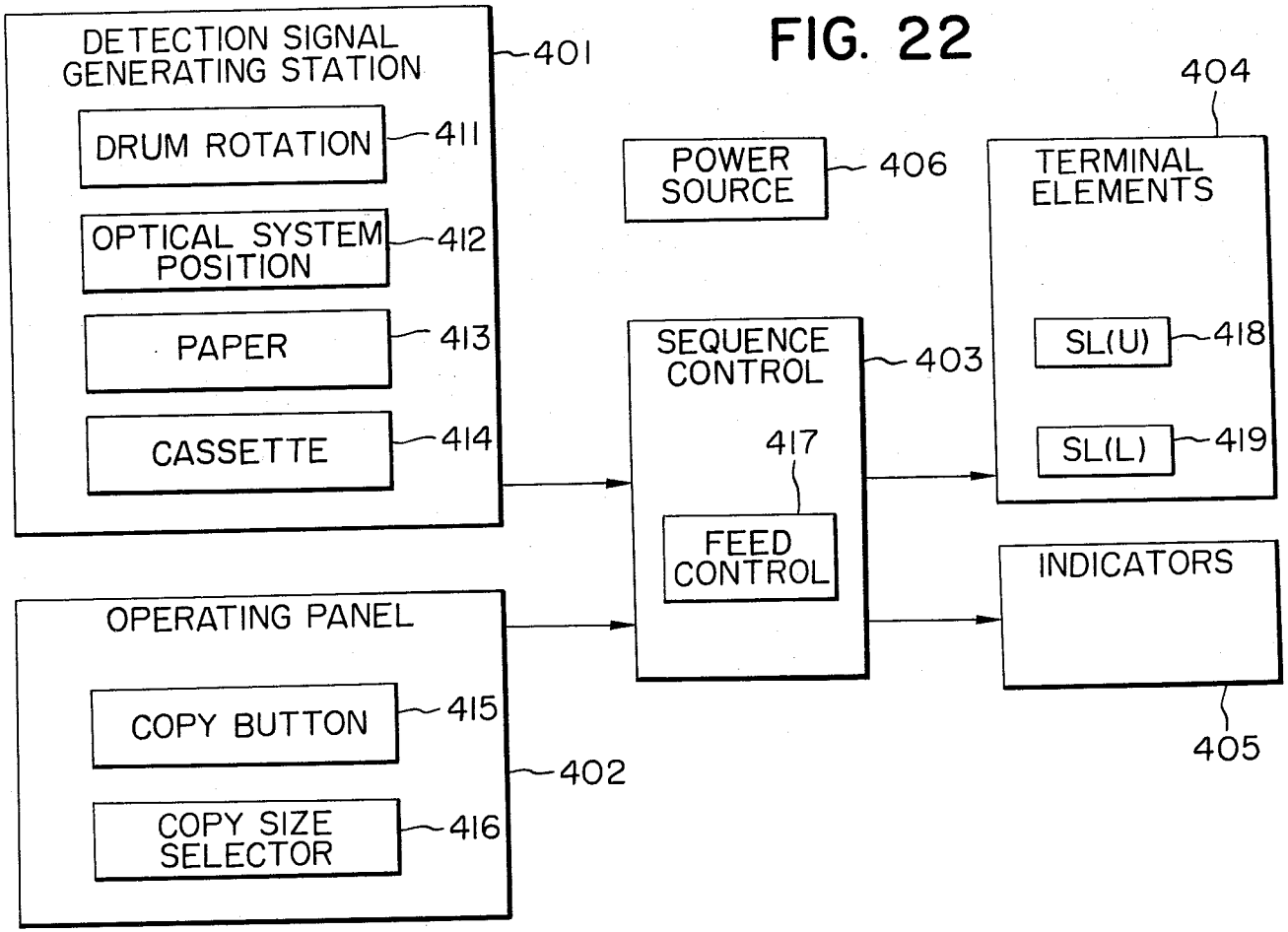
FIG. 22 is a block diagram of the electric control circuit.

Description will now be made of an embodiment of the electric control circuit according to the present invention. The electric control circuit may generally be divided into those blocks which are shown in FIG. 22. First, a detection signal generating station 401 comprises a group of devices for generating various necessary detection signals for controlling the copying process, including a photosensitive drum position detector 411, an optical system position detector 412, paper detectors 413, cassette detectors 414, and other unshown devices for detecting the quantity and concentration of developer and temperatures of various portions. The drum position detector 411 generates, in accordance with various rotational positions of the photosensitive drum 1, necessary signals for the drum synchronization type control circuit of the copying machine, such as a signal representing the arrival of the photosensitive drum at its end-of-rotation position, a timing signal for starting the advance of the optical system during the exposure stroke, and a timing signal for detecting any jam.

Nevertheless, the present invention is not restricted to such drum synchronization type control circuit. The optical system position detector 412 generates a signal representing the advance-starting position (home position) of the optical system to be moved during the exposure stroke, signals representing various turn-back positions corresponding to the various copy sizes, and a position detection signal which provides a copy medium feed timing signal to be described. The paper detectors 413 are provided at necessary points for monitoring the normal transport of the copy medium and, upon occurrence of jam, detect the jam with the aid of the signal from the photosensitive drum position detector 411. The cassette detectors 414 are provided at the points whereat various cassettes are mounted and detect the presence of the cassettes at those points or the presence of copy mediums in the cassettes to put out various signals as the condition signals to the feed control circuit. This will further be described hereinafter.

The detection signal generating station 401, as already mentioned, includes further devices but these are not directly related to the present invention and need not be described.

An operating panel 402 includes a copy button device 415 and other unshown devices such as copy number set dial, copy stop button, etc., all of which are the devices for generating signals as determined by the operator as in the conventional copying machine. The operating panel further includes a copy size selecting button device 416 which will further be described.

A sequence control station 403 generates drive instruction signals to various terminal elements to execute the above-mentioned copying process in accordance with the signals from the detection signal generating station 401 and the operating panel 402, and in addition to the sequence controls, it performs the functions of detecting jam, generating various indication instruction signals, etc.

In the present embodiment, the control circuit is constructed chiefly by the use of digital IC forming a binary logic circuit, and may functionally be divided into a main drive motor control section for driving the photosensitive drum, an optical system movement (forward, backward, stoppage) control section, various illumination elements, a heater element control section, a high voltage source control section, a jam discriminating and treating section, and a feed control circuit portion 417, but this control circuit is substantially similar to that in the conventional copying machine excepting for the feed control circuit portion 417. The various terminal elements 404 include a high voltage source, a main drive motor, illuminators for image original, heaters for fixation, cassette change-over and drive motor, and electrical terminal elements such as electromagnetic clutch, plunger and counter, etc. These elements are electrically energized in accordance with the drive instruction signals from the sequence control station 403 to perform their respective functions. Indicators 405 effect various indications required for the convenience to the operator, such as copy number indication during continuous copying, jamming indication, developer and copy medium supply indications, etc., chiefly in accordance with the indication instruction signals from the sequence control 403. A power source station 406 includes a main switch, circuit breaker, door switch, power source transformer and voltage stabilizing circuit section, and supplies a necessary alternating or direct current to the aforementioned various stations.

Figure 23:
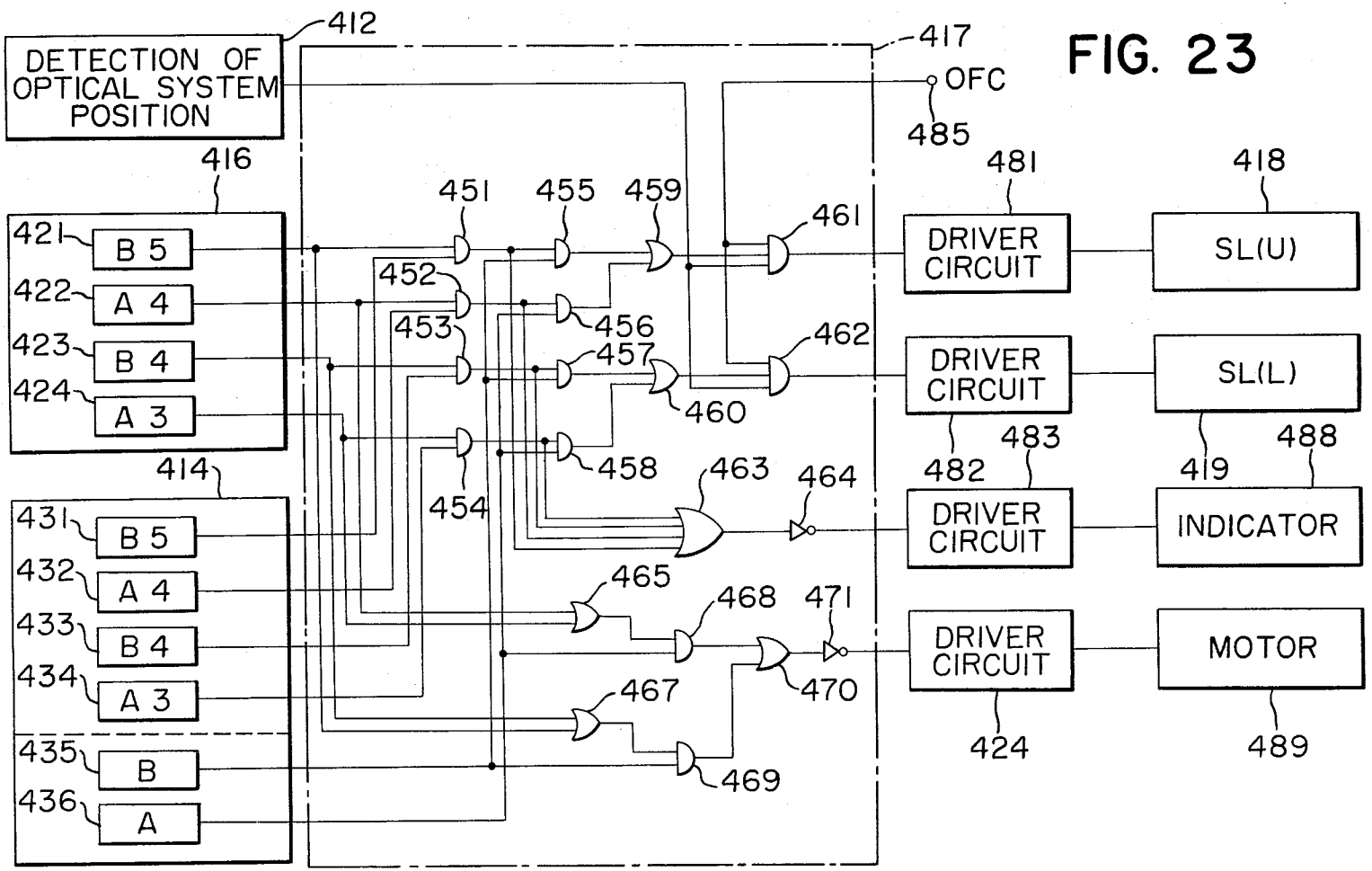
FIG. 23 is a circuit diagram of the electric control circuit.

The copying process may be controlled by the contruction generally described above. Reference will now be had to FIG. 23 to describe the electrical control for the feed operation which is a feature of the present invention. In FIG. 23, copy size selector button devices 416 include B5 size selector button device 421, A4 size selector button device 422, B4 size selector button device 423 and A3 size selector button device 424, and these button devices in turn include respective copy size selector buttons shown at 152 in FIG. 3.

When the B5 size button is depressed, the B5 size selector button device 421 puts out a signal for logic "1" (hereinafter simply referred to as "1" as opposed to logic "0" which will also be simply referred to as "0") through some specific means which need not be described herein. Likewise, when the other button A4, B4 or A3 is depressed, the A4, B4 or A3 size selector button device 422, 423 or 424 puts out "1" which is applied to the feed control circuit section 417. The cassette detector device 414 includes not only the B5 cassette detector 431 but also A4, B4 and A3 cassette detectors 432, 433 and 434. These four cassette detectors are installed for the four cassettes shown in FIG. 4, namely, the first, second, third and fourth cassettes from top to bottom, to detect the presence of the respective cassettes and of copy mediums therein. More specifically, as shown in FIG. 4, in the upper feeding section, the B5 cassette detector may be formed by including an ultrasonic wave transmitter 441 secured to the machine body and an ultrasonic wave receiver 442 secured to the upper cassette cradle and disposed so as to interrupt the ultrasonic wave transmitted from the transmitter 441 only when the uppermost or B5 cassette is in the upper feeding position with copy mediums present therein.

That is, when the B5 cassette is mounted in the feeding section but no ultrasonic wave is received by the ultrasonic wave receiver 442, there are copy mediums in the cassette and a predetermined copy cycle may be carried on. However, description will hereinafter be made with the understanding that "1" is then put out from the B5 cassette detector 431. Likewise, for the second uppermost or A4 cassette, an ultrasonic wave transmitter 443 is installed as is the transmitter 442 for the B5 cassette detector 431, and when the A4 cassette is mounted in the upper feeding section with copy mediums present therein, "1" is put out from the A4 cassette detector 432. Again in the lower feeding section, an ultrasonic wave transmitter 444 similar to the transmitter 441 in the upper feeding section is installed and for the third and fourth or B4 and A3 cassettes, ultrasonic wave transmitters 445 and 446 are respectively secured to the cassette cradle as is the case with the B5 and A4 cassettes. The B4 and A3 cassette detectors 433 and 434 including respective receivers put out "1" when the respective cassettes are set in the feeding positions with copy mediums present therein. The cassette detector device 414 further includes B-size set detector 435 and A-size set detector 436 which indicate the setting of B5, B4 cassettes and A4, A3 cassettes upon depression of the aforementioned microswitches MS1 and MS2 and which put out "1" in the respective cases. The six different signals put out from this cassette detector device 414 are also applied to the feed control circuit 417.

In the feed control circuit 417, the outputs from the B5 size selector button device 421 and the B5 set detector 431 are first applied to the input terminals of two-input AND gate 451 and the outputs from the gate 451 and the B-size set detector 435 are applied to the input terminals of two-input AND gate 455. The operation of the AND gate in the digital IC is such that it puts out "0" whenever "0" is applied to any one of its plural input terminals and that it puts out "1" only when "1" is applied to all of its input terminals. Thus, the output of the gate 455 is "1" when the B5 copy size selector button is depressed and B-size cassettes are set in the feeding section with copy mediums present therein.

In the case of A4, B4 and A3 sizes, when the conditions such as depression of the respective size selector buttons, setting of the corresponding cassettes to the feeding section and the presence of copy mediums in these cassettes are all fulfilled, the outputs of the two-input AND gates 456, 457 and 458 assume "1" in accordance with the respective sizes. Further, the outputs of the gates 455 and 456 are applied to the input terminals of two-input OR gate 459, the output of which is in turn applied to one of the input terminals of three-input AND gate 461. The operation of this OR gate is such that it puts out "1" whenever "1" is applied to any one of its plural input terminals and that it puts out "0" only when "0" is applied to all of its input terminals and therefore, the output of the gate 459 is "1" when the B5 or the A4 size is selected and the output of the gate 455 or 456 is "1". To the other two input terminals of the three-input AND gate are applied two signals, that is, the signal which provides the feed timing for copy medium is applied as "1" from the aforementioned optical system position detector 412 and the optical system forward instruction signal OFC generated in the sequence control 403 is applied as "1" from the terminal 485. Thus, the output of the gate 461 is "1" when the output of the gate 459 is "1" and the forwardly moving optical system has reached the feed timing position, and this signal "1" is further applied to a driver circuit 481 to thereby energize the aforementioned solenoid (plunger) SL(U) 418, whereupon copy mediums begin to be fed from the B5 or the A4 cassette. Likewise, in the case of B4 and A3, the solenoid SL(L) is energized through two-input OR gate 460, three-input AND gate 462 and driver circuit 482 so that copy mediums begin to be fed in accordance with the desired size.

Also, the outputs of the two-input AND gates 451, 452, 453 and 454 are applied to the respective input terminals of four-input OR gate 463, whereby the output of this gate 463 is "0" when all the four inputs are "0". This indicates that there is no copy medium present in the cassette of the copy size selected by the operator depressing a size selector button, and in this case, the output of the gate 463 is inverted to "" through an inverter 464, and may further be passed through a driver circuit 483 to cause a copy medium supply indicator 488 in the indicator section 405 to indicate the need for supply of copy mediums. Subsequently, signals from the A4 and A3 copy size selector button devices 422 and 424 are applied to the respective input terminals of two-input OR gate 465, whereby the output of this gate 465 is "1" when the A-size copy is selected. Also, signals from the B5 and A4 copy size selector button devices 421 and 423 are applied to the respective input terminals of two-input OR gate 467, whereby the output of this gate 467 is "1" during the B-size copy. Further, the output of the gate 465 and the signal from the A-size cassette set detector 436 are applied to the respective input terminals of two-input AND gate 468 while the output of the gate 467 and the output of the B-size cassette set detector 435 are applied to the respective input terminals of two-input AND gate 469 and moreover, the outputs of the gates 468 and 469 are in turn applied to the respective input terminals of two-input OR gate 470, so that the output of the gate 470 is "0" when the copy size selected by the copy size selector button device 416 is not coincident with the size of the actually set cassette.

The output of the gate 470 is inverted through an inverter 471, whereupon the output of this inverter assumes "1" and is put out as cassette displace instruction signal, which is applied through a driver 484 to energize the cassette driving motor M 489. When the selected copy size has become coincident with the cassette size and the output of the gate 470 has become "1", namely, the output of the inverter has become "0", the motor is deenergized to complete the setting of the cassette.

The feed control circuit 416 has been described, and an entirely similar control circuit is equally applicable even if one of the cassettes is of the manual supply type as already described in connection with an embodiment of the cassette loading system. That is, in the description already made with B5, A4, B4 and A3 cassettes as an example, these sizes of cassettes are not restrictive.

We claim:

1. A copy material feeding device, comprising:

a cassette unit provided with a plurality of cassettes each having a copy material feeding portion which is disposed out of vertical alignment with another cassette, wherein said cassettes are mounted on said cassette unit such that the relative distances between the feeding portions of said cassettes are constant at all times;

single feeding means for feeding copy material in a predetermined direction of movement from the feeding portion of a cassette positioned adjacent thereto; and means for moving said cassette unit in the direction of movement of the copy material to position a selected one of said cassettes with its feeding portion adjacent to said feeding means without moving any of said cassettes relative to said cassette unit.

2. A copy material feeding device according to claim 1, further comprising an additional cassette unit provided with a plurality of cassettes each having a copy material feeding portion which is disposed out of vertical alignment with another cassette, means for integrally supporting said cassette unit and said additional cassette unit and an additional feeding means for said additional cassette unit.

3. A copy material feeding device according to claim 1, further comprising means for each cassette for covering the feeding portion of the associated cassette when said cassette is spaced from said feeding means in order to prevent the copy material within said cassette from being exposed to atmosphere.

4. A copy material feeding device according to claim 1, wherein one of said cassettes is constructed for permitting an operator manually to insert therein copy material which is not normally contained in the cassette.

5. A copy material feeding device according to claim 1, wherein each of said cassettes is detachably mountable to said cassette unit.

6. A copy material feeding device according to claim 1, wherein each of said mounted cassettes is slanted relative to a horizontal plane.

7. A copy material feeding device according to claim 1, further comprising means for displacing said cassette unit in accordance with an instruction signal.

8. A copy material feeding device according to claim 1, further comprising means for actuating said feeding means in accordance with a signal selecting an individual cassette and a signal representing the presence of copy material within the selected cassette.

9. A copy material feeding device according to claim 1, wherein the path of movement of said cassette unit defines a vertical plane.

* * * * *

UNITED STATES PATENT OFFICE

CERTIFICATE OF CORRECTION

Patent No. 4,108,427 Dated August 22, 1978

Inventor(s) SHIGEHIRO KOMORI, ET AL

It is certified that error appears in the above-identified patent and that said Letters Patent are hereby corrected as shown below:

Column 5, line 27, "113" should read --118--;

Column 6, line 64, "CL" should read --Cℓ--;

Column 7, line 55, "CL" should read --Cℓ--;

Column 14, line 38, "416" should read --417--.

Signed and Sealed this

*Third* Day of *April 1979*

[SEAL]

*Attest:*

RUTH C. MASON
*Attesting Officer*

DONALD W. BANNER
*Commissioner of Patents and Trademarks*